US010041262B2

(12) United States Patent
Cruickshank

(10) Patent No.: US 10,041,262 B2
(45) Date of Patent: Aug. 7, 2018

(54) LAP SIDING PRODUCT WITH SNAP BREAK

(71) Applicant: LOUISIANA-PACIFIC CORPORATION, Nashville, TN (US)

(72) Inventor: Mark Cruickshank, Chester (CA)

( * ) Notice: Subject to any disclaimer, the term of this patent is extended or adjusted under 35 U.S.C. 154(b) by 0 days.

(21) Appl. No.: 15/658,698

(22) Filed: Jul. 25, 2017

(65) Prior Publication Data

US 2018/0030741 A1 Feb. 1, 2018

Related U.S. Application Data

(60) Provisional application No. 62/366,579, filed on Jul. 25, 2016, provisional application No. 62/377,955, filed on Aug. 22, 2016.

(51) Int. Cl.
*E04F 21/18* (2006.01)
*E04F 13/08* (2006.01)

(52) U.S. Cl.
CPC ..... *E04F 21/1855* (2013.01); *E04F 13/0801* (2013.01)

(58) Field of Classification Search
CPC ... E04F 21/1855; E04F 13/0801; E04F 13/07; E04F 2201/01; E04C 2/38
See application file for complete search history.

(56) References Cited

U.S. PATENT DOCUMENTS

D561,916 S * 2/2008 Visintin ..... D25/119
7,325,325 B2 * 2/2008 Gleeson ..... E04C 2/043 33/1 B
D634,026 S * 3/2011 Baccarini ..... D25/61
D661,818 S * 6/2012 Hamblin ..... D25/119
8,695,303 B2 * 4/2014 Swanson ..... E04D 3/24 52/478
D783,185 S * 4/2017 Bruns ..... D25/138
9,663,954 B1 * 5/2017 Fernandez ..... E04D 1/04
2007/0193150 A1 * 8/2007 Carlson ..... E04F 13/007 52/302.1
2011/0023409 A1 * 2/2011 Krantz ..... E04B 1/161 52/745.05
2013/0199121 A1 * 8/2013 Grau ..... E04C 2/30 52/588.1
2013/0202841 A1 * 8/2013 Kompe ..... B32B 3/02 428/76

OTHER PUBLICATIONS

Search Report and Written Opinion for PCT/US2017/043678 dated Oct. 10, 2017 (7 pages). (Year: 2017).*

* cited by examiner

*Primary Examiner* — Rodney Mintz
(74) *Attorney, Agent, or Firm* — Wayne Edward Ramage; Baker Donelson

(57) ABSTRACT

A lap siding product with a central face cut, allowing an installer or user to break the lap siding product in half manually, without tools, resulting in two pieces of lap siding. The central face cut extends for the length of the product, and its depth is a substantial portion of the thickness of the lap siding product. A central back cut opposite to the central face cut may be provided, as well as a pair of back spacing cuts along the edges of the back face of the product. A pair of machined nail lines on the face of the product assist in determining locations for nailing the post-break pieces of lap siding during installation.

12 Claims, 5 Drawing Sheets

LAP SIDING PRODUCT WITH SNAP BREAK

This application claims benefit of and priority to U.S. Provisional Applications No. 62/366,579, filed Jul. 25, 2016, and No. 62/377,955, filed Aug. 22, 2016, and is entitled to those filing dates for priority. The specifications, figures, and complete disclosures of U.S. Provisional Application Nos. 62/366,579 and 62/377,955 are incorporated herein in their entireties by specific reference for all purposes.

FIELD OF INVENTION

This invention relates to a lap siding product with a manual snap break, and related methods of manufacture and use. More specifically, this invention relates to a prefinished lap siding product that can be manually snapped in half without tools to produce to lap siding boards or panels.

SUMMARY OF INVENTION

In various embodiments, the present invention comprises a lap siding product with a central face cut, allowing an installer or user to break the lap siding product in half manually, without tools, resulting in two pieces of lap siding. In several embodiments, the lap siding is prefinished (i.e., painted, treated, etc.). The central face cut extends for the length of the product, and its depth is a substantial portion of the thickness of the lap siding product. The central face cut may be the sole central cut, although in several alternative embodiments, a central back cut opposite to the central face cut may be provided. The combination of the face cut and back cut result in an easy manual break that is much cleaner (i.e., with smoother edges, fewer splinters, etc.) than a single cut.

The lap siding product further may comprise a pair of back spacing cuts along the edges of the back face of the product. The back spacing cuts extend the length of the product, and assist in horizontal location of the pieces of lap siding (i.e., after manual breaking) with respect to each other. The back spacing cut of a piece of lap siding is positioned on the bottom of the lap siding, and sits on top of an already-installed piece of lap siding.

The lap siding product also may comprise a pair of machined nail lines on the face of the product, which may extending the length of the product. The nail lines assist in determining locations for nailing the post-break pieces of lap siding during installation.

DETAILED DESCRIPTION OF EXEMPLARY EMBODIMENTS

In various exemplary embodiments, as seen in FIGS. 1-4, the present invention comprises a lap siding product 10 (which may be comprised of wood, manufactured wood or lignocellulosic material, plastic, composite, combinations thereof, or other suitable material). Prior to installation, the lap siding product comprises an elongated panel or board with a face or front side and a back side. In several embodiments, the lap siding product is prefinished (i.e., painted, treated, etc.) along one or both sides. The lap siding product also may be unfinished.

The front side comprises a central face (or front side) cut 20, which allows an installer or user to break the lap siding product in half manually, without tools, resulting in two pieces of lap siding 10*a*, 10*b*. The central face cut 20 extends for the length of the product, and its depth is a substantial portion (e.g., greater than 50%, 75%, or 80%) of the thickness of the lap siding product. The central face cut 20 may be the sole central cut, although in several alternative embodiments, a central back (back side) cut 22 opposite to the central face (front side) cut 20 may be provided. The central back side cut may be aligned with the central face cut, and has a depth less than the central face cut, and less than half the thickness of the product. In one exemplary embodiment, the central back cut has a depth of from about 5% to about 10% of the thickness of the product. The combination of the face cut and back cut result in an easy manual break that is much cleaner (i.e., with smoother edges, fewer splinters, etc.) than a single cut.

Figure 5:
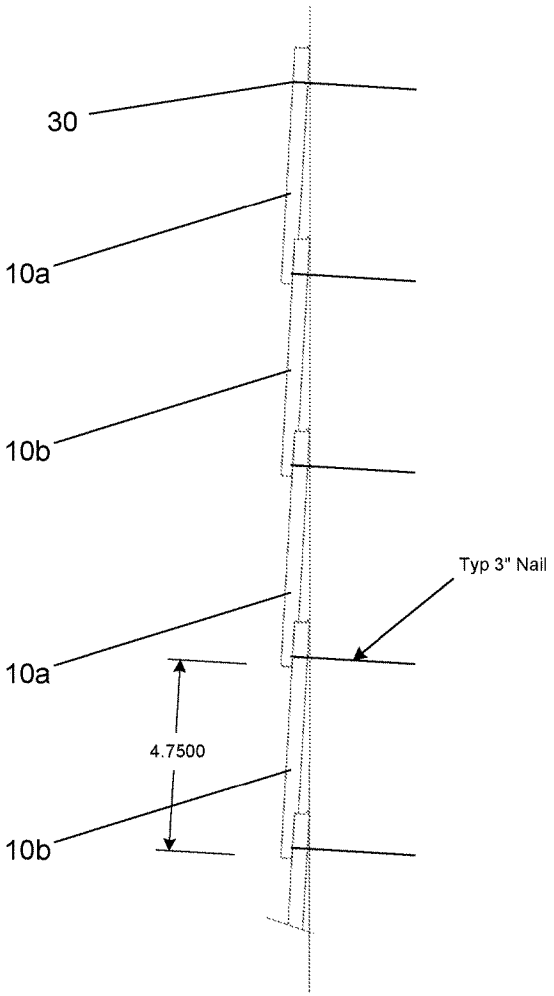
FIG. 5 shows a cross-section view of the lap siding obtained from the lap siding product installed upon a vertical wall.

The lap siding product further may comprise a pair of back spacing cuts 40 along the edges of the back face of the product. The back spacing cuts extend the length of the product, extend internally, and assist in horizontal location of the pieces of lap siding (i.e., after manual breaking) with respect to each other during installation, as seen in FIG. 5. During installation, the outside edges of the lap siding product become the "bottom" edge of the respective pieces of lap siding, while the broken center face cut becomes the "top" edge of the respective piece of lap siding The back spacing cut of a piece of lap siding thus is positioned along the bottom of the lap siding, and the inner edge of the back spacing cut sits or rests on the top of the lower (already-installed) piece of lap siding.

Figure 1:
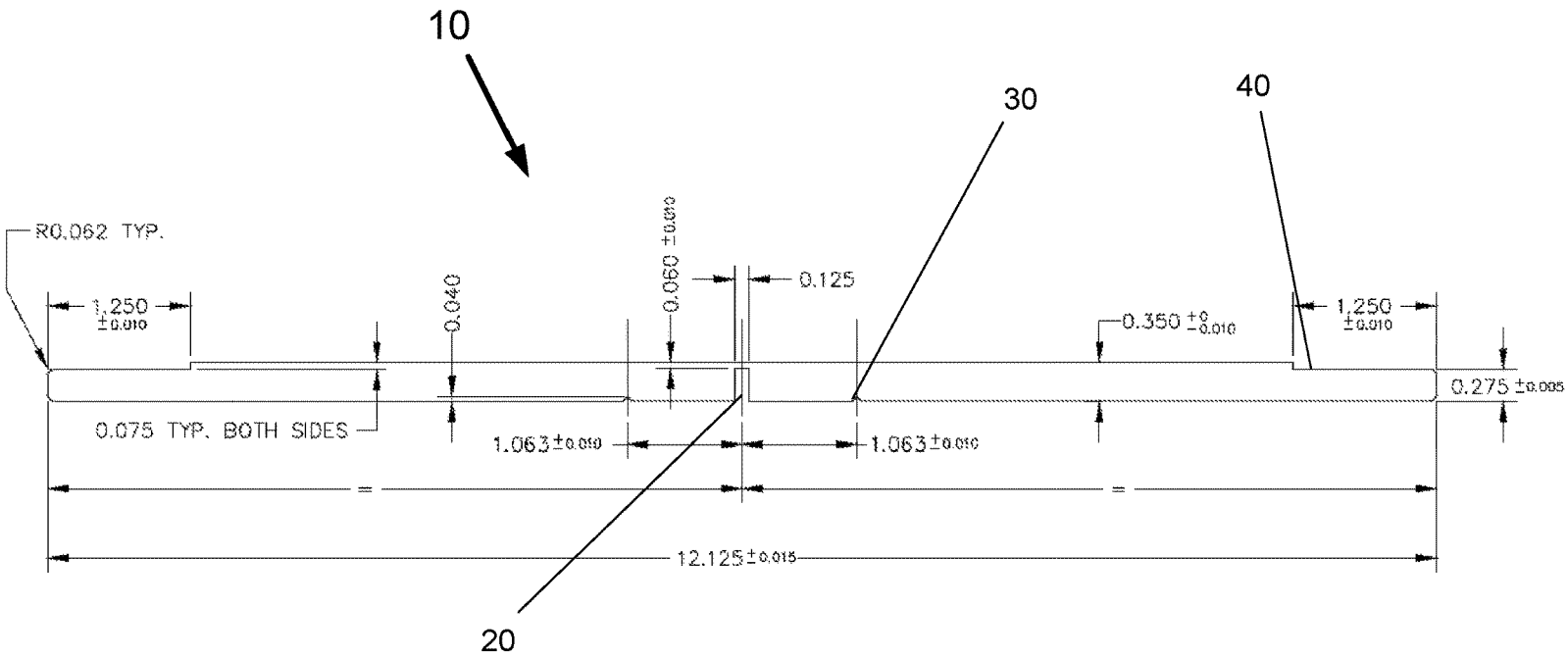
FIG. 1 shows a cross-section view of a lap siding product in accordance with an embodiment of the present invention.
Figure 2:
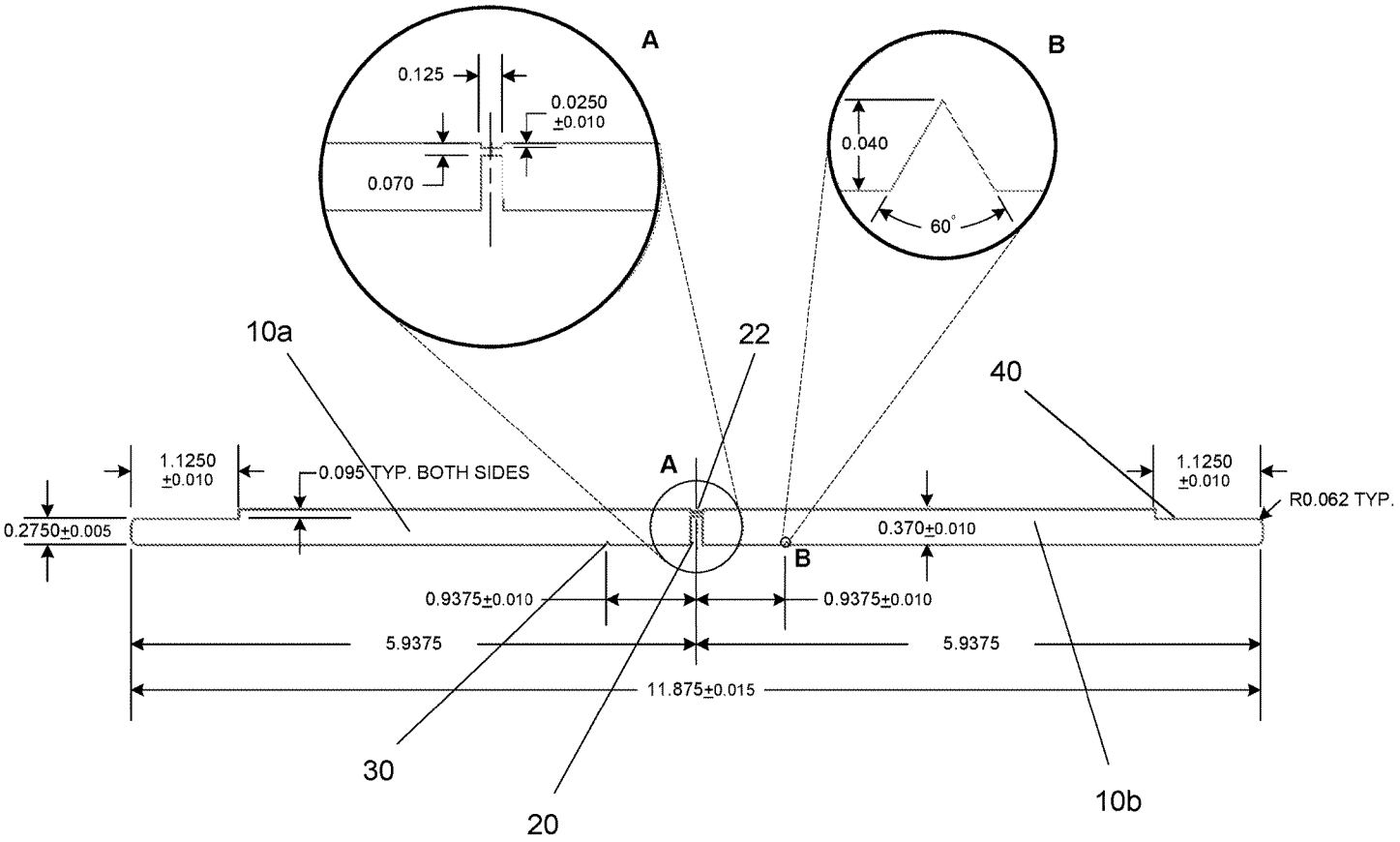
FIG. 2 shows a cross-section view of a lap siding product in accordance with another embodiment of the present invention.
Figure 3:
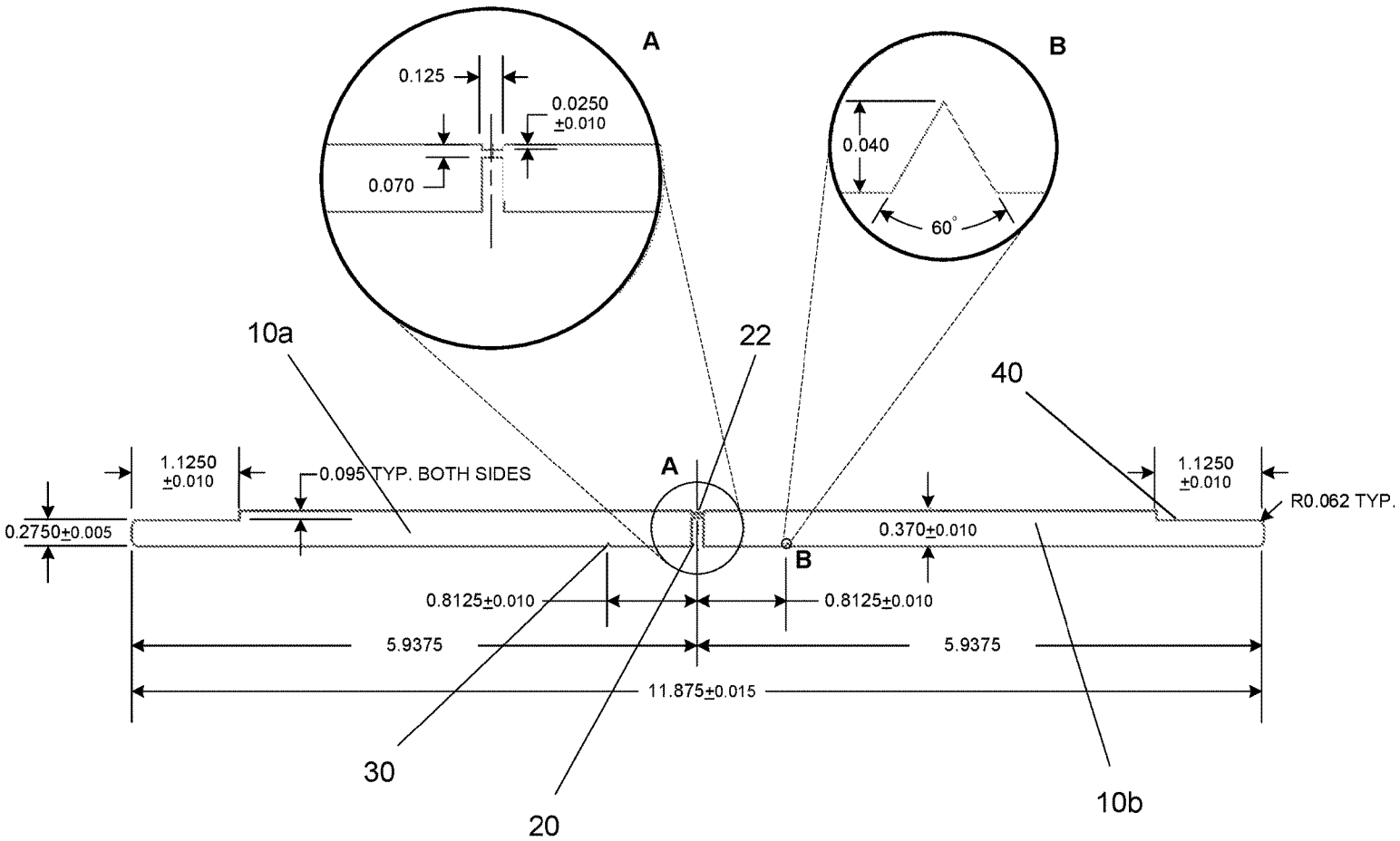
FIG. 3 shows a cross-section view of another embodiment of a lap siding product.
Figure 4:
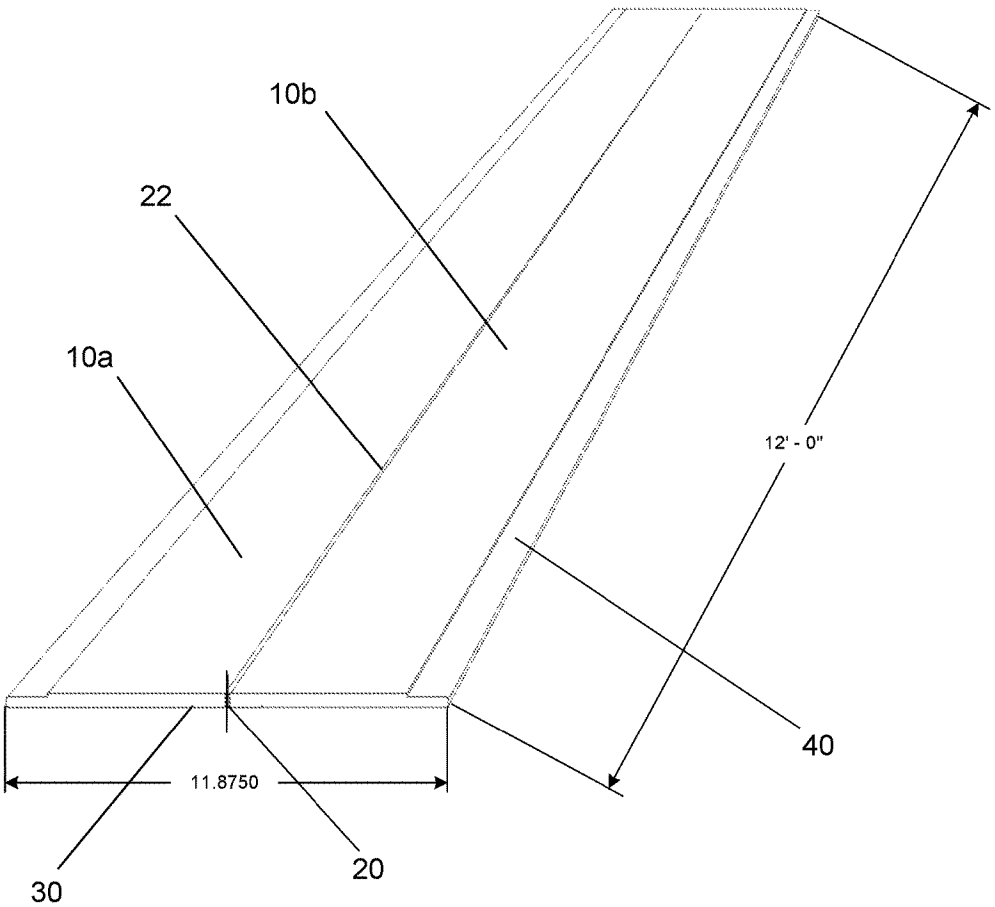
FIG. 4 shows a perspective view of the lap siding product.

The back spacing cuts extend along all or substantially all of the respective edge of the product, and inward for some distance towards the center of the product. The width and depth of the back spacing cuts may vary based on the type of lap siding, and may even vary on the same piece of lap siding product, although, as seen in FIG. 2, the width and depth of the back spacing cuts may be the same. In several embodiments, the back spacing cuts extend inward for about 15% to about 25% of the width of the respective lap siding piece (i.e., about 7.5% to about 12.5% of the width of the product pre-installation). In the embodiments shown in FIGS. 2 and 3, the back spacing cuts extend inward for about 18% to about 19% of the width of the respective lap siding piece. In several embodiments, the back spacing cuts may have a depth of half or less of the thickness of the lap siding, more preferably 20% to 35% of the thickness, or, as shown in FIGS. 2 and 3, about 25% of the thickness.

The lap siding product also may comprise a pair of machined nail lines 30 on the face of the product, which may extend all or substantially all of the length of the product. The nail lines assist in determining locations for nailing the post-break pieces of lap siding during installation. In one exemplary embodiment, the nail lines are located parallel to the central face cut at a distance less than the width of the back spacing cuts (in one preferable embodiment, about three-quarters to one inch from the central face cut, as seen in FIG. 2). During installation, the nail line of each piece of installed lap siding, and the nails used, thus are covered by the bottom edge of the overlapping lap siding piece above it.

In addition to ease of use in the field during installation, the lap siding product described herein also results in substantial savings and efficiency during manufacture. Instead of line production of prefinished lap siding pieces individually, the present invention allows the production of two prefinished lap siding pieces as a single product, thereby doubling the finishing line output rate, and resulting in an approximately 50% reduction in variable labor and energy costs.

The dimensions of the product, and the resulting pieces of siding, may vary. For example, in the embodiment shown in FIG. 1, the product is 0.35 inches thick, 12.125 inches wide, and 12 feet long. The central face cut is 0.125 inches wide, and is approximately 0.29 inches deep, and allows the product, when snapped in half, to form two pieces of siding approximately 6 inches wide and 12 feet long. The back spacing cuts are 0.075 inches deep, and 1.25 inches in width. The nail lines are 0.040 inches deep and are located 1.063 inches from the center of the product.

Alternatively, in the embodiments shown in FIGS. 2 and 3, the product is approx. ⅜ (0.375 or 0.370) inches thick, 11.875 inches wide, and 12 feet long. The central face cut is 0.125 inches wide, and is approximately 0.30 inches deep. The central back cut is 0.125 inches wide, and is approximately 0.025 inches deep. When snapped in half, the product to form two pieces of siding approximately 5.9 inches wide and 12 feet long. The back spacing cuts are 0.095 inches deep, and 1.125 inches in width. The nail lines are located 0.9375 inches (FIG. 2) or 0.8125 niches (FIG. 3) from the center of the product, and form a V-shaped 60-degree notch 0.040 inches deep.

In one embodiment, the method of use of the present invention comprises providing a prefinished lap siding product as described herein, manually snapping the product in half along its length without the use of tools into a first piece 10*a* and a second piece 10*b*, nailing (using the nail lines as guides) the first piece into place laterally on a wall or vertical structure with the face side outward and the back spacing cut positioned along the bottom and facing inward, aligning the second piece into an overlapping position above the first piece, and nailing (using the nail lines as guides) the second piece into place overlapping the first piece. A vertical series of overlapping siding pieces can thus be installed, each piece extending laterally, as seen in FIG. 5.

In several embodiments, due to the positioning and depth of the central front side cut and the depth of the spacing cuts, any residual "ridge" left in or near the central front side cut when the product is broken or divided into two pieces is located behind the back side of the overlapping lap siding piece when installed, so that the ridge does not interfere with installation. When a central back cut is used (to assist in ease of dividing the product by hand), the resultant ridge is located along the resulting "top" edge of each lap siding piece, but towards the back, so that it remains located behand the back side of the overlapping piece when installed.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A lap siding product, comprising:

an elongated rectilinear panel with a length, a front side and a back side with a thickness therebetween, and a first edge and a second edge with a width therebetween;

a central front side cut extending the length of the panel midway between the first edge and the second edge, said central front side cut having a depth extending half or more of the thickness of the panel;

a central back side cut aligned with the central front side cut and extending the length of the panel;

a first back spacing cut positioned along the first edge and extending the length of the panel;

a second back spacing cut positioned along the second edge and extending the length of the panel;

wherein the panel is configured to be divided along the central front side cut into a first lap siding piece and a second lap siding piece.

2. The lap siding product of claim 1, wherein the panel is unfinished.

3. The lap siding product of claim 1, wherein the panel is finished or painted, in whole or in part.

4. The lap siding product of claim 1, wherein the panel is configured to be divided along the central front side cut manually without tools.

5. The lap siding product of claim 1, wherein the central front side cut has a depth from about 75% to about 85% of the thickness of the panel.

6. The lap siding product of claim 1, wherein the first and second back spacing cuts have a depth extending less than half of the thickness of the panel.

7. The lap siding product of claim 1, wherein the first and second back spacing cuts have a depth extending approximately one-quarter of the thickness of the panel.

8. The lap siding product of claim 1, wherein the central back side cut has a depth extending less than half of the thickness of the panel.

9. The lap siding product of claim 1, wherein the central back side cut has a depth from about 5% to about 10% of the thickness of the panel.

10. The lap siding product of claim 1, further comprising a first nail guide line and a second nail guide line extending on the front side of the panel for all or substantially all of the length of the panel.

11. The lap siding product of claim 10, wherein the first and second nail guide lines are substantially parallel to the central front side cut.

12. The lap siding product of claim 11, wherein the first nail guide line and the second nail guide lines are on opposite sides of the central front side cut.

* * * * *